United States Patent [19]

Greeves

[11] Patent Number: 4,691,864

[45] Date of Patent: Sep. 8, 1987

[54] FUEL INJECTION NOZZLES

[75] Inventor: Godfrey Greeves, Hatch End, England

[73] Assignee: Lucas Industries public limited company, Birmingham, England

[21] Appl. No.: 799,868

[22] Filed: Jan. 17, 1986

Related U.S. Application Data

[62] Division of Ser. No. 550,098, Nov. 9, 1983, abandoned.

[30] Foreign Application Priority Data

Nov. 25, 1982 [GB] United Kingdom ..... 8233641

[51] Int. Cl.[4] ..... B05B 1/32

[52] U.S. Cl. ..... 239/453; 239/533.7; 239/533.9

[58] Field of Search ..... 239/453, 533.3–533.12, 239/94, 96, 584

[56] References Cited

U.S. PATENT DOCUMENTS 2,295,081 9/1942 Harvath ..... 239/533.7

2,901,185 8/1959 Dickey ..... 239/453

4,417,693 11/1983 Füssner et al. ..... 239/453

FOREIGN PATENT DOCUMENTS 830589 1/1952 Fed. Rep. of Germany ... 239/533.7

2093118 8/1982 United Kingdom ..... 239/533.9

*Primary Examiner*—Andres Kashnikow

*Assistant Examiner*—Daniel R. Edelbrock

[57] ABSTRACT

A fuel injection nozzle of the outwardly opening type has a nozzle body defining a bore in which is slidable the stem of a valve member having a head. A spring biases the head into contact with a seating to prevent fuel flow through an outlet opening from a fuel inlet connected to a nozzle inlet. An insert has a skirt portion which engages with the body to define a closed chamber. The valve stem forms part of the wall of the chamber and as the valve member is moved towards the open position the volume of the chamber is increased thereby causing a restraining force to be applied to the valve member additional to the force exerted by the spring.

4 Claims, 5 Drawing Figures

FUEL INJECTION NOZZLES

This is a division of application Ser. No. 550,098, filed Nov. 9, 1983, now abandoned.

This invention relates to a fuel injection nozzle for supplying fuel to an internal combustion engine, the nozzle being of the so-called outwardly opening type and comprising a valve assembly including a body defining an outlet opening, a bore in the body extending into the outlet opening, a valve member including a stem in the bore, a valve head carried by the stem, said head being located in said outlet opening and being shaped for co-operation with a seating defined at the entrance to the bore from the opening, resilient means acting on the valve member for biasing the head into contact with the seating, a fuel inlet to said bore, said fuel inlet being connected to a nozzle inlet which in use, is connected to the outlet of a high pressure fuel supplying device, said valve member controlling the flow of fuel from said nozzle inlet to an outlet.

In known forms of such nozzles the valve assembly is carried within a housing which defines a cavity into which the nozzle inlet opens. The cavity accommodates a spring which constitutes the resilient means and the end of the valve stem remote from the head is exposed within the cavity. As a result when fuel under pressure is admitted to the cavity, the fuel pressure acts upon the area of the valve stem to life the valve head from the seating and also acts when the valve head has lifted slightly from the seating, on the additional annular area presented by the valve head being that area which lies outside the projected area of the bore. The tendency is for the valve member to move quickly against the action of the spring to the fully open position with the result that the effect of any special shaping of the valve head and the wall of the outlet opening or any special orifice arrangement extending from the walls of the opening or both, and which is designed to provide a gradual increase in the area of the fuel flow path, is largely lost. One way of controlling the opening of the valve member would be to provide a high rate spring. However, the design of such a spring which is small enough in physical size, presents practical difficulties.

The object of the invention is to provide a nozzle of the kind specified in a form in which the opening of the valve member can be controlled in a simple and convenient form.

According to the invention a fuel injection nozzle of the kind specified comprises a chamber part of the wall of which is defined by the valve stem, the volume of said chamber increasing as the valve member is moved by fuel under pressure to the open position whereby a restraining force additional to the force exerted by the spring, is applied to the valve member.

Examples of fuel injection nozzle in accordance with the invention will now be described with reference to the accompanying drawings in which:-

Figure 1:
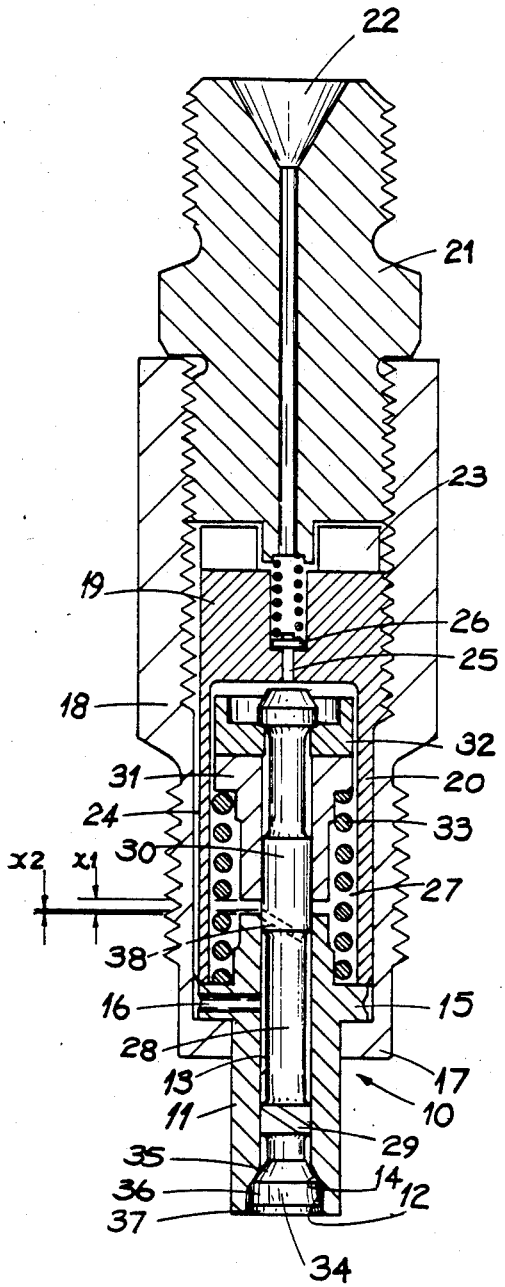
FIG. 1 is a sectional side elevation of one example of a nozzle.

With reference to FIG. 1 of the drawings, the nozzle comprises a valve assembly generally indicated at 10 and including a flanged body 11 defining an outlet opening 12 into which extends a bore 13. The wall of the opening 12 is of right cylindrical form and a valve seating 14 is defined at the entrance of the bore into the opening. The seating is of truncated conical shape.

The flange 15 of the body is provided with a fuel inlet 16 which extends into the bore 13 and the flange is located against the end wall 17 of a cup-shaped housing portion 18, the end wall 17 being provided with an aperture through which the body 11 extends. The housing portion 18 is provided with a peripheral screw thread so that the nozzle can be screwed into a complementarily threaded bore in the cylinder head of an engine, the body 11 extending through a reduced portion of the bore into a combustion chamber of the engine. In addition, the housing portion 18 has an internally screw threaded portion with which is engaged an insert 19 having a skirt portion 20 which engages with the flange 17 in sealing engagement therewith. The open end of the housing portion 18 is closed by a plug 21 which defines a nozzle fuel inlet 22 the latter being connected by a passage, with a transfer groove 23 which is formed in the end portion of the insert 19 remote from the skirt portion thereof. Moreover, the transfer groove 23 communicates by way of a longitudinal groove 24 formed in the periphery of the skirt portion, with the aforesaid fuel inlet 16.

The insert 19 is provided with a passage 25 which contains a spring loaded non-return valve 26, the passage communicating with the interior of a chamber 27 which is bounded by the wall of the insert 19 and its skirt portion together with the body 11 of the valve assembly.

Part of the wall of the chamber 27 is also defined by the valve stem 28.

The valve assembly also includes a valve member having the stem 28 which is of smaller diameter than the bore 13 except for a fluted portion 29 and a plain cylindrical portion 30. These two portions co-operate with the wall of the bore 13 to guide the movement of the valve member. The portion 30 extends beyond the bore and is coupled to a spring abutment sleeve 31 which is retained relative to the stem by means of a retainer 32. The spring abutment is engaged by one end of a spring 33 the other end of which engages with the flange 15.

The valve member also includes a head 34 which is generally larger in diameter than the bore 13. The head includes a first portion 35 which s of truncated conical form having a cone angle slightly greater than that of the seating 14. This merges with a further truncated portion 36 having a cone angle which is appreciably smaller than that of the portion 35 and the portion 36 merges with a right cylindrical portion 37 which defines a small annular clearance with the wall of the outlet opening 12.

As stated the fuel inlet 16 extends into the bore 13 and this coincides with the portion of the valve stem lying between the portions 29 and 30. The cylindrical portion 30 is provided with an inclined groove 38 or a drilling. The groove 38 or the drilling communicates with the interior of the bore 13 and in the closed position of the valve member as shown, projects slightly beyond a tubular portion of the body 11 beyond the flange 15. The groove 38 therefore in the closed position of the valve member is in communication with the chamber 27.

In operation, when the fuel under pressure from a fuel injection pump is supplied to the nozzle inlet, the fuel under pressure will travel along the transfer groove 23 and down the longitudinal groove 24 to the fuel inlet 16. From the inlet 16 it will pass into the cavity 27 by way of the groove 38 and it will also flow past the fluted portion 29 to the valve head. As a result, the fuel pressure acts upon the end of the stem, the area of which is equivalent to the area of the bore 13 and by virtue of the different angles of the seating and the portion 35 of the valve head, on a first annular area which lies outside the projected area of the bore 13. The force exerted on the valve member moves the valve member against the action of the spring 33 and immediately an additional annular area of the valve head is exposed to fuel under pressure. Fuel will therefore flow through the annular clearance defined between the wall of the opening 12 and the cylindrical portion 37 of the valve head. This fuel will issue as a spray into the combustion chamber of the associated engine. However, as the valve member moves against the action of the spring the groove 38 will be obturated by the aforesaid tubular portion of the valve assembly with the result that the chamber 27 which in fact is increasing in volume as the valve member is lifted from the seating, becomes cut off from the fuel inlet 16. The first effect of this is that a reduced area is available for the fuel under pressure to act upon to continue to lift the valve head from its seating but in addition, the fact that the chamber 27 is now cut off from the supply of fuel, means that the pressure in the chamber reduces and this reduced pressure acting on the end of the valve member further restrains the movement of the valve member. As a result, the movement of the valve member is restrained so that the shaping of the truncated portion 36 in relation to the wall of the opening, can have a desired effect in varying the area of the opening through which fuel flows to the engine.

It will be noted that during opening of the valve member the one way valve 26 is closed. The purpose of the valve is to permit rapid return of the valve member to the closed position when the supply of fuel by the pump ceases. It is inevitable due to the reduced pressure in the chamber 27, that some fuel will leak into the chamber along the working clearance between the cylindrical portion 30 and the wall of the bore and this additional volume of fuel would tend to hinder the return motion of the valve member. The one way valve 26 is therefore provided and this opens when the pressure at the nozzle inlet 22 falls, to permit substantially unhindered return motion of the valve head towards the seating.

In FIG. 1, the movement of the valve member which takes place before closure of the groove 38 is indicated by the dimension X2 and the total allowed movement of the valve member is indicated by the dimension X1, this being represented by contact of the spring abutment 31 with the aforesaid tubular portion of the body 11.

Figure 2:
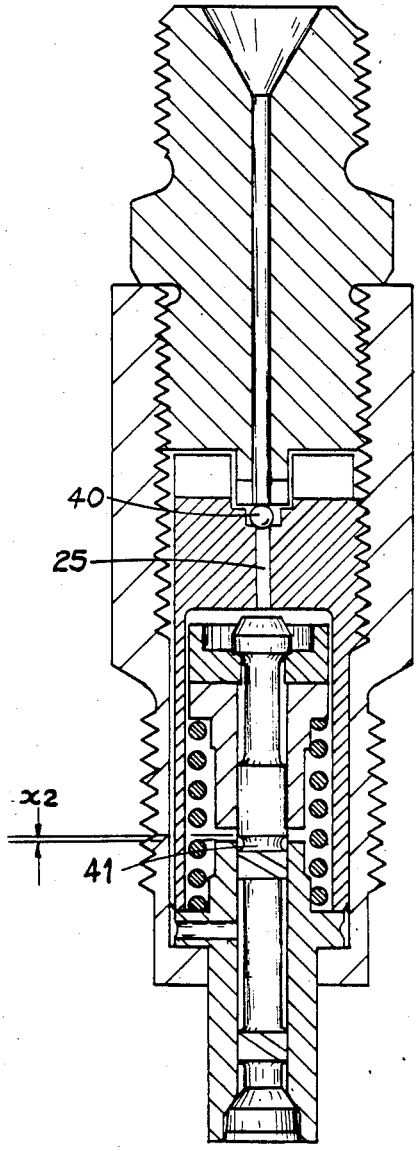
FIG. 2 is a view similar to FIG. 1 showing modifications to the nozzle of FIG. 1.

The nozzle which is shown in FIG. 2 is essentially the same as that which is shown in FIG. 1. There are however two constructional differences. The first such difference is in relation to the type of one way valve, the valve 26, comprising a spring loaded plate. In the example of FIG. 2 a ball 40 is provided which in the particular example, is not spring loaded. The ball 40 will tend to be moved to close the passage 25 by the action of the rising fuel pressure at the inlet and will be held in this position by the pressure difference as the valve member continues to move. The other difference is in relation to the groove 38. In the example of FIG. 2 the groove 38 is replaced by a circumferential groove 41 which communicates with the inlet 16. The practical effect of this groove is the same as that of the groove 38.

Figure 3:
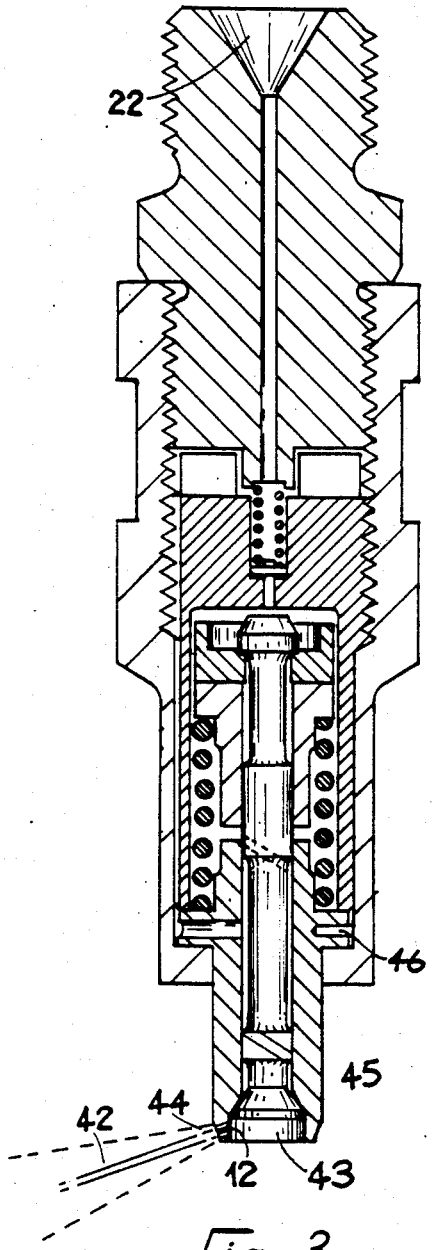
FIG. 3 is a view similar to FIG. 1 but showing a modified outlet arrangement.

Referring now to FIG. 3, the nozzle shown therein has an internal construction identical with that of the nozzle of FIG. 1. The difference lies however in the fact that instead of providing an annular spray of fuel, the nozzle is constructed so as to provide a jet or jets of fuel as indicated at 42. For this purpose, the cylindrical portion 43 of the valve head is axially longer than the portion 37 of the valve head of FIG. 1 and has a close working clearance with the wall 12 of the opening. The effect of this is that substantially no fuel flows along the working clearance between the cylindrical portion and the wall 12 of the opening. However, the cylindrical portion 43 serves to control the opening of axially spaced outlet orifices 44 which are drilled into the body 45 of the valve assembly. As a result when the valve head 43 initially moves away from the seating, one orifice will be uncovered to receive fuel derived from the nozzle inlet 22 and as continued movement of the valve member takes place a further orifice will be uncovered. As a result a penetrative spray is produced and this is particularly desirable in some types of engine combustion chamber. Since it is necessary to ensure that the orifices 44 are positioned correctly in the combustion chamber, the flange of the valve assembly is provided with a pin 46 which is engaged within a longitudinal slot formed in the wall of the housing portion. In addition, the latter is devoid of screw threads and will be clamped in a predetermined position in the bore of the engine.

In respect of the inclined grooves 38 in the examples of FIGS. 1 and 3, these can be designed to constitute orifices so as to provide further control of the opening movement of the valve member. In addition, it is possible to eliminate the grooves 38 entirely so that the chamber 27 has no communication whatsoever with the nozzle inlet. The chamber is of appreciable volume but as will be appreciated this has the effect of firstly preventing fuel under pressure acting on the valve stem to assist the opening of the valve member and secondly as soon as movement of the valve member takes place, a restraining effect is applied to the movement of the valve member. It may still be necessary due to the aforesaid problems of leakage to provide a one way valve through which the chamber can vent to the fuel inlet when the supply of fuel ceases. It will be appreciated that in all the examples in the closed position of the valve member the pressure in the various passages of the nozzle will be the lowest pressure at the nozzle inlet, it being conventional practice to reduce the pressure in the pipeline following delivery of fuel, in order to ensure rapid closure of the valve member.

Figure 4:
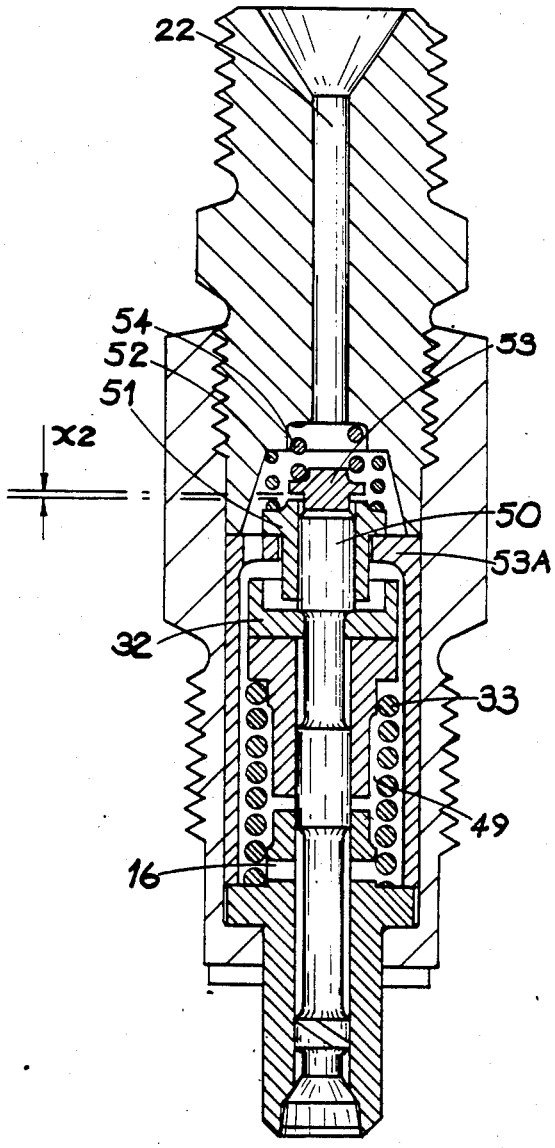
FIG. 4 is a view similar to FIG. 1 showing a further example of a nozzle unit according to the invention.
Figure 5:
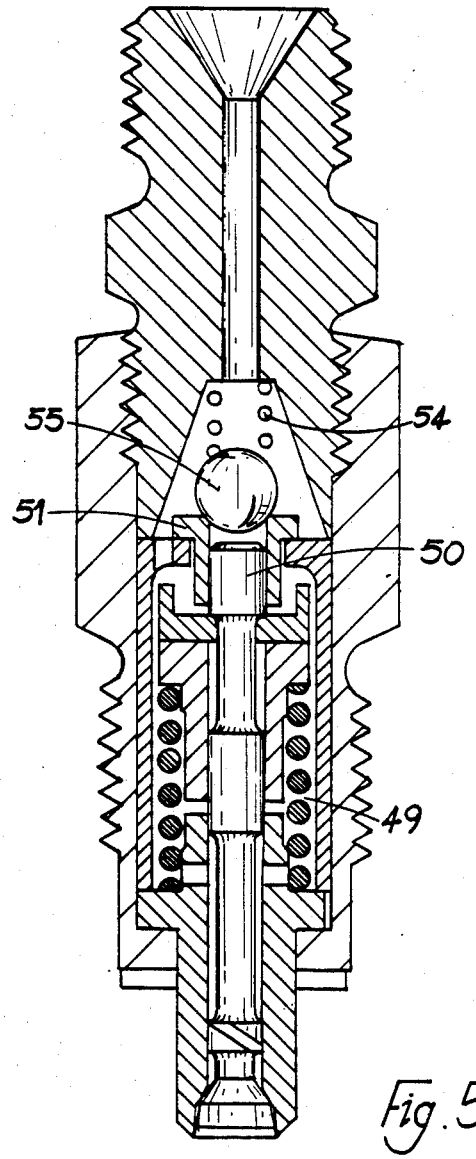
FIG. 5 is a view similar to FIG. 1 showing a modification of the nozzle unit of FIG. 4.

Turning now to the nozzles shown in FIGS. 4 and 5. These nozzles have a general construction which is similar to the nozzles in the earlier figures. One difference however is the fact that the chamber 49 which accommodates the spring, is firstly in permanent communication with the nozzle inlet 22 and also the fuel inlet 16 is in permanent communication with the chamber 49. This is as would be found in conventional outwardly opening fuel injection nozzles. It will be noted however that the valve stem has an extended portion beyond the retainer 32. The extended portion has been assigned the reference numeral 50 and constitutes a piston which is slidable within an axially movable outwardly flanged sleeve member 51. In the example of FIG. 4 the sleeve member 51 is biased by means of a spring 52, towards the valve assembly of the nozzle into contact with a stop 53A which is constituted by the equivalent of the insert 19 in the earlier examples. In addition, a valve element 53 is provided which is slightly smaller than the diameter of the bore in the sleeve, and which is provided with a peripheral flange engaged by a spring 54. The flange of the element 53 can engage with the end surface of the sleeve to prevent admission of fuel into the bore formed by the sleeve. This bore together with the piston 50 constitutes a chamber the volume of which as will be explained, increases as the valve member of the nozzle moves away from its seating. In the rest position as shown, the element 53 is engaged by the piston 50 to create a small clearance referenced X2, between the flange of the element and the sleeve. When fuel under pressure is supplied to the nozzle inlet 22, the pressure acts upon the valve stem and also the annular portion of the head as discussed in relation to the example of FIG. 1, and the valve member will move against the action of the spring 33. During such movement, the clearance X2 diminishes until sealing engagement occurs between the flange and the sleeve. As soon as this takes place, the chamber can no longer receive fuel and the practical effect is that besides preventing fuel under pressure acting upon the area of the valve stem, a restraining force is created in view of the fact that the chamber is increasing in volume. When the supply of fuel through the nozzle inlet ceases, the valve member is returned to the closed position and in so doing axial movement of the element 53 and/or sleeve 51 can take place to allow rapid movement of the valve member to the closed position. It is anticipated that between deliveries of fuel, the sleeve 51 and element 53 will return to their rest positions as shown, under the action of the springs 52, 53. This ensures that the chamber is depressurised to the value of the residual pressure in the inlet 22. The sleeve 51 has radial clearance with the aperture in the stop 53A in order to obviate alignment difficulties.

A slightly different arrangement is shown in FIG. 5. The valve element 53 is replaced by a ball 55 and the sleeve 51 is no longer provided with a spring. The ball 55 however is biased into contact with the sleeve by the spring 54. Moreover, it will be noted that the piston 50 is slightly shorter so that it does not contact the ball. In operation therefore the ball 55 protects the stem of the valve member from the fuel under pressure and as a result, the valve member can only open under the action of the fuel under pressure acting upon the truncated portion of the valve head. Moreover, the chamber which is defined by the piston and the sleeve is blocked off but increases in volume and hence will act to restrain the movement of the valve member. During the return motion of the valve member to its seating, the spring biasing the ball 55 will be compressed to permit movement of the ball and/or sleeve to avoid restraining the return motion of the valve member. In the intervals between delivery of fuel through the nozzle the spring 54 will ensure that the fuel in the chamber will be depressurised to the value of the residual pressure.

I claim:

1. A fuel injection nozzle for supplying fuel to an internal combustion engine, the nozzle being of the so-called outwardly opening type and comprising a valve assembly including a body defining an outlet opening, a bore in the body extending into the outlet opening, a valve member including a stem in the bore, a valve head carried by the stem, said head being located in said outlet opening and being shaped for co-operation with a seating defined at the entrance to the bore from the opening, resilient means acting on the valve member for biasing the head into contact with the seating, a fuel inlet to said bore, the nozzle including a nozzle inlet connected to said fuel inlet, the nozzle inlet in use being connected to the outlet of a high pressure fuel supplying device, said valve member controlling the flow of fuel from said nozzle inlet through said outlet opening, a chamber, part of the wall of which is defined by the valve stem, the free volume of the chamber increasing as the valve head moves away from the seating, a groove or passage formed in a part of said stem through which said chamber is connected to said nozzle inlet, said part of said stem having the same diameter as the bore, the portion of the stem between said part and the valve head defining a clearance with the bore, the clearance communicating with said nozzle inlet, said groove or passage communicating with said clearance and extending beyond an end of said bore to communicate with said chamber in the closed position of the valve member, the wall of the bore obturating said groove or passage during the movement of the valve member to the open position so that said groove or passage is closed after a predetermined movement of the valve head away from said seating, continued movement of the valve head away from the seating after said groove or passage has closed causing a reduction in the pressure in said chamber, thereby creating a restraining force on said valve member additional to the force exerted by said resilient means.

2. A nozzle according to claim 1 including valve means operable to allow fuel flow out of said chamber as the valve member is moved by the resilient means to the closed position following cessation of fuel delivery through the nozzle.

3. A nozzle according to claim 2 in which said valve means when open, allows fuel flow from said chamber to the nozzle inlet.

4. A nozzle according to claim 1 in which said chamber is defined by an insert which defines a skirt portion, said skirt portion being in sealing engagement with a flange on said body, said resilient means being located within the chamber and said fuel inlet being formed in said flange.

* * * * *